US005542404A

United States Patent [19]

Hasegawa et al.

[11] Patent Number: 5,542,404

[45] Date of Patent: Aug. 6, 1996

[54] TROUBLE DETECTION SYSTEM FOR INTERNAL COMBUSTION ENGINE

[75] Inventors: Yusuke Hasegawa; Yoichi Nishimura; Isao Komoriya; Shushuke Akazaki, all of Wako, Japan

[73] Assignee: Honda Giken Kogyo Kabushiki Kaisha, Tokyo, Japan

[21] Appl. No.: 383,373

[22] Filed: Feb. 3, 1995

[30] Foreign Application Priority Data

Feb. 4, 1994 [JP] Japan ..... 6-033200

[51] Int. Cl.[6] ..... F02D 41/00

[52] U.S. Cl. ..... 123/690

[58] Field of Search ..... 123/690, 479, 123/673, 481, 425, 489, 685, 674

[56] References Cited

U.S. PATENT DOCUMENTS

| | | | |
|---|---|---|---|
| 4,947,818 | 8/1990 | Kamohara et al. | 123/479 |
| 5,070,847 | 12/1991 | Akiyama et al. | 123/489 |
| 5,115,781 | 5/1992 | Kurita et al. | 123/481 |
| 5,131,372 | 7/1992 | Nakaniwa | 123/673 |
| 5,168,854 | 12/1992 | Hashimoto et al. | 123/425 |
| 5,184,595 | 2/1993 | Maeda et al. | 123/690 |
| 5,197,450 | 3/1993 | Kitajima et al. | 123/685 |
| 5,213,088 | 5/1993 | Harada | 123/674 |

FOREIGN PATENT DOCUMENTS

| | | |
|---|---|---|
| 2-275043 | 11/1990 | Japan . |
| 3-6037 | 1/1991 | Japan . |
| 4-369471 | 12/1992 | Japan . |
| 7-83094 | 3/1995 | Japan . |

*Primary Examiner*—Raymond A. Nelli

*Attorney, Agent, or Firm*—Nikaido, Marmelstein, Murray & Oram LLP

[57] ABSTRACT

A malfunction detecting system for an internal combustion engine utilizes an air/fuel ratio feedback control loop. Namely, feedback factors #nKLAF operate to absorb the air/fuel ratio variance between cylinders and to converge the individual cylinders' air/fuel ratios to the confluence point air/fuel ratio, while another feedback factor KLAF operates to converge the confluence point air/fuel ratio to a desired air/fuel ratio, converging all cylinders' air/fuel ratios to the desired air/fuel ratio. With this arrangement, any of the feedback factors #nKLAF for a certain cylinder becomes a prescribed value, it can therefore be assumed that any abnormality would occur in a part such as the fuel injector which would affect the air/fuel ratio in the cylinder concerned. Similarly, if the confluence point air/fuel ratio feedback factor KLAF becomes another prescribed value, it can be assumed that any abnormality would occur in a part such as the fuel pressure system which would affect the air/fuel ratios of all the cylinders. By discriminating these factors, malfunctions can be detected immediately and accurately.

6 Claims, 11 Drawing Sheets

TROUBLE DETECTION SYSTEM FOR INTERNAL COMBUSTION ENGINE

BACKGROUND OF THE INVENTION

1. Field of the Invention

This invention relates to a system for detecting a malfunction which may occur in an internal combustion engine, more specifically to a system for detecting a malfunction which may occur in a part such as the fuel injector in the internal combustion engine.

2. Description of the Prior Art

When a malfunction occurs in a part of an internal combustion engine such as the fuel injector, it is important that it be detected immediately and troubleshooted as soon as possible. Japanese Laid-open Utility Model Application Hei 3(1991)-6,037 describes a malfunction detection system for an internal combustion engine, in which the fuel injection quantity is determined for four individual cylinders by adjusting the basic fuel injection quantity using cylinder-by-cylinder correction factors which are in creased/decreased in response to detected individual cylinders' air/fuel ratios. In the system, the correction factor for a certain cylinder is compared with those for the other three cylinders and if the deviation is significant, it is assumed that the fuel injector for the cylinder concerned has become clogged. More specifically, the correction factors for the other three cylinders are averaged and the average obtained is compared with the factor for the cylinder in question. If the factor is found to exceed the average, the fuel injector for the cylinder is assumed to be clogged.

Thus, in order to detect the fuel injector's malfunction, in the prior art system, it is necessary to calculate the average value of the correction factors. The system is disadvantageously complicated, and the detection accuracy is not always satisfactory, leaving much to be desired.

An object of the invention therefore is to solve the drawbacks of the prior art system and to provide a system for detecting a malfunction occurring in an internal combustion engine in a part such as the fuel injector, which can detect a malfunction immediately but has a less complicated structure and improved detection accuracy.

Moreover, although the prior art system is capable of detecting a malfunction such as the fuel injector's trouble which may occur locally at a certain cylinder, the system is unable to detect a malfunction which may occur in the overall system such as the fuel supply system of the engine common to all the cylinders.

Another object of the invention therefore is to provide a system for detecting a malfunction occurring in an internal combustion engine which is also able to detect a malfunction in the overall engine system common to all the cylinders.

SUMMARY OF THE INVENTION

For realizing these objects, the present invention provides a system detecting a malfunction occurring in an internal combustion engine, comprising air/fuel detecting means for detecting exhaust air/fuel ratio at a confluence point of an exhaust system of the engine, air/fuel ratio determining means for determining exhaust air/fuel ratios in individual cylinders of the engine, first feedback factor determining means for determining a confluence point air/fuel ratio feedback factor KLAF in response to an error between the detected exhaust confluence point air/fuel ratio and a desired air/fuel ratio, second feedback factor determining means for determining cylinder-by-cylinder air/fuel ratio feedback factors #nKLAF for the individual cylinders at least in response to a variance between the determined exhaust individual cylinders' air/fuel ratios, feedback control means for determining a fuel injection quantity to be supplied to the individual cylinders such that the error between the detected exhaust confluence point air/fuel ratio and the desired air/fuel ratio decreases, discriminating means for discriminating whether at least one of the feedback factors #nKLAF is within a predetermined range, and malfunction detecting means for assuming that, when at least one of the feedback factors #nKLAF is discriminated to be outside of the predetermined range, a malfunction has occurred in a part of the engine which would affect the air/fuel ratio in the cylinder concerned.

BRIEF EXPLANATION OF THE DRAWINGS

These and other objects and advantages of the invention are explained in the following description and drawings, in which.

DETAILED DESCRIPTION OF THE PREFERRED EMBODIMENTS

Embodiments of the invention are explained below with reference to the drawings.

Figure 1:
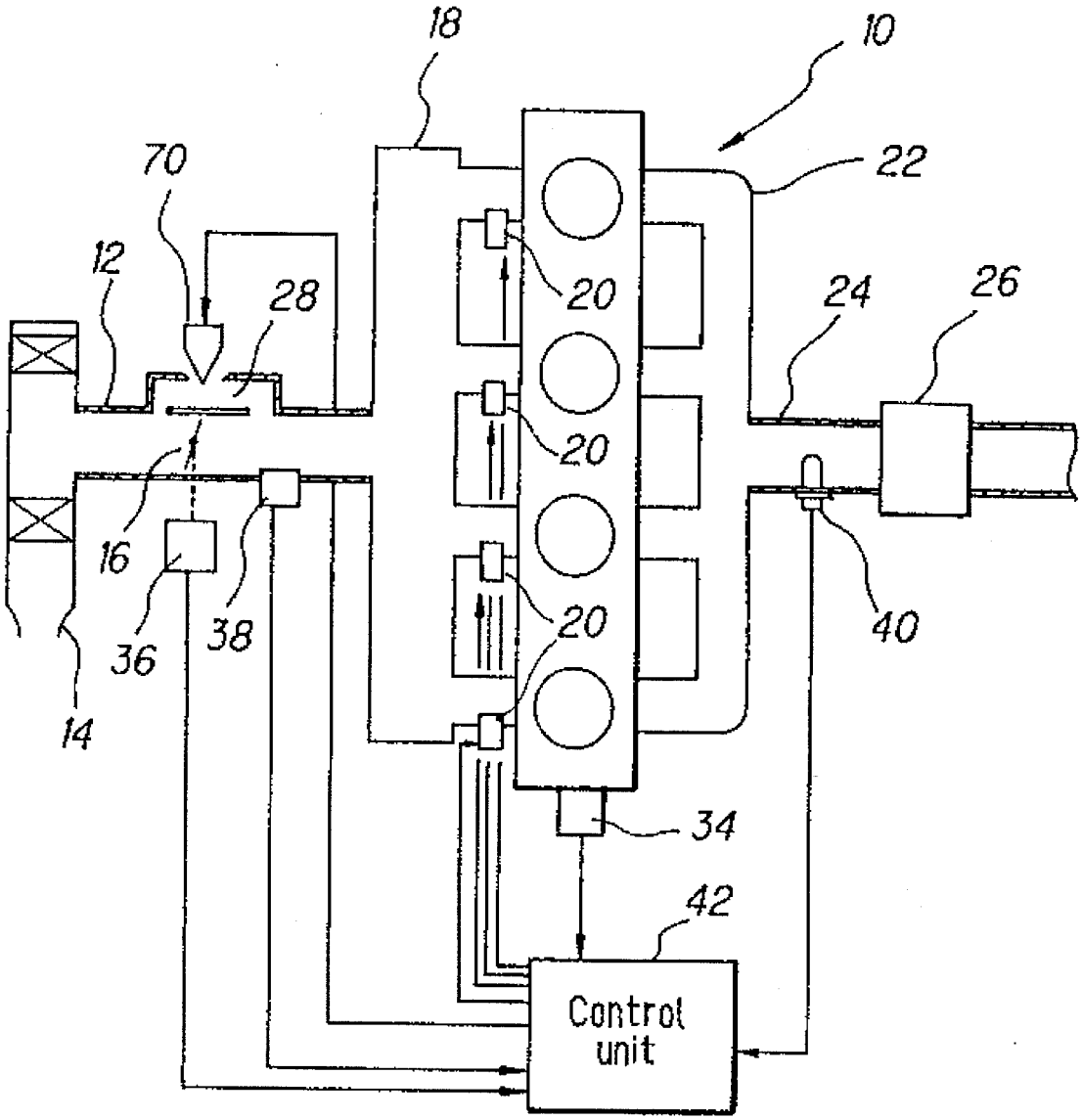
FIG. 1 is an overall schematic view of the trouble detection system for internal combustion engine according to the present invention.

FIG. 1 is an overall schematic view of an air/fuel ratio feedback control system including a malfunction detection system for an internal combustion engine according to the invention.

Reference numeral 10 in this figure designates a four-cylinder internal combustion engine. Air drawn in through an air cleaner 14 mounted on the far end of an air intake path 12 is supplied to the first to fourth cylinders through an intake manifold 18 while the flow thereof is adjusted by a throttle valve 16. A fuel injector 20 for injecting fuel is installed in the vicinity of the intake valve (not shown) of each cylinder. The injected fuel mixes with the intake air to form an air-fuel mixture that is ignited in the associated cylinder by a spark plug (not shown). The resulting combustion of the air-fuel mixture drives down a piston (not shown). The exhaust gas produced by the combustion is discharged through an exhaust valve (not shown) into an exhaust manifold 22, from where it passes through an exhaust pipe 24 to a three-way catalytic converter 26 where it is removed of noxious components before being discharged to the exterior. In addition, the air intake path 12 is bypassed by a bypass 28 which is located near the throttle valve 16.

A crank angle sensor 34 for detecting the piston crank angles is provided in the distributor (not shown) of the internal combustion engine 10, a throttle position sensor 36 is provided for detecting the degree of opening of the throttle valve 16, and a manifold absolute pressure sensor 38 is provided for detecting the pressure of the intake air downstream of the throttle valve 16 as an absolute pressure. A wide-range air/fuel ratio sensor 40 constituted as an oxygen concentration detector is provided in the exhaust system at a point between the exhaust manifold 22 and the three-way catalytic converter 26. The wide-range air/fuel ratio sensor 40 produces an output proportional to the oxygen concentration of the exhaust gas. The outputs of the sensors 34 etc. are sent to a control unit 42.

Figure 2:
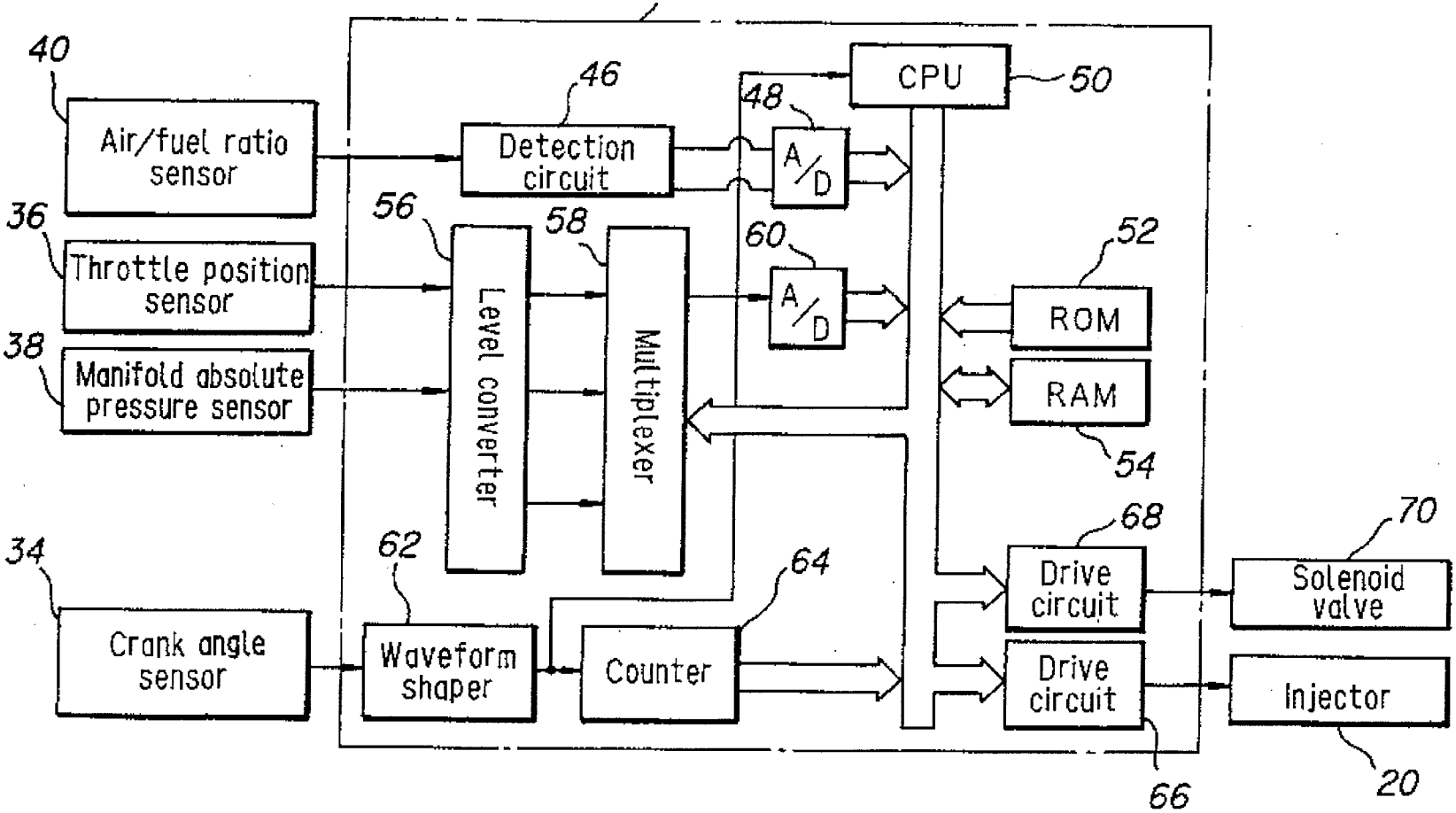
FIG. 2 is a block diagram which shows the details of a control unit illustrated in FIG. 1.

Details of the control unit 42 are shown in the block diagram of FIG. 2. The output of the wide-range air/fuel ratio sensor 40 is received by a detection circuit 46 in the control unit 42, where it is subjected to appropriate linearization processing to obtain an air/fuel ratio which varies linearly with the oxygen concentration of the exhaust gas over a broad range centered on the stoichiometric air/fuel ratio and extending from the lean side to the rich side. As this air/fuel ratio is explained in detail in the assignee's earlier Japanese Laid-open Patent Application No. Hei 4(1992)-369471, it will not be explained further here. Hereinafter in this explanation, the air/fuel ratio sensor will be referred to as "LAF" sensor (linear A/F sensor). The output of the detection circuit 46 is forwarded through an A/D (analog/digital) converter 48 to a microcomputer comprising a CPU (central processing unit) 50, a ROM (read-only memory) 52 and a RAM (random access memory) 54 and is stored in the RAM 54.

Similarly, the analogue outputs of the throttle position sensor 36 etc. are inputted to the microcomputer through a level converter 56, a multiplexer 58 and a second A/D converter 60, while the digital output of the crank angle sensor 34 is shaped by a waveform shaper 62 and has its output value counted by a counter 64, the result of the count being input to the microcomputer. In accordance with commands stored in the ROM 52, the CPU 50 of the microcomputer uses the detected values to compute a control input, drives the fuel injectors 20 of the respective cylinders via a drive circuit 66 and drives a solenoid valve 70 via a second drive circuit 68 for controlling the amount of secondary air passing through the bypass 28. At the same time, the CPU 50 also detects a malfunction which may occur anywhere in the internal combustion engine in a manner explained later.

Figure 3:
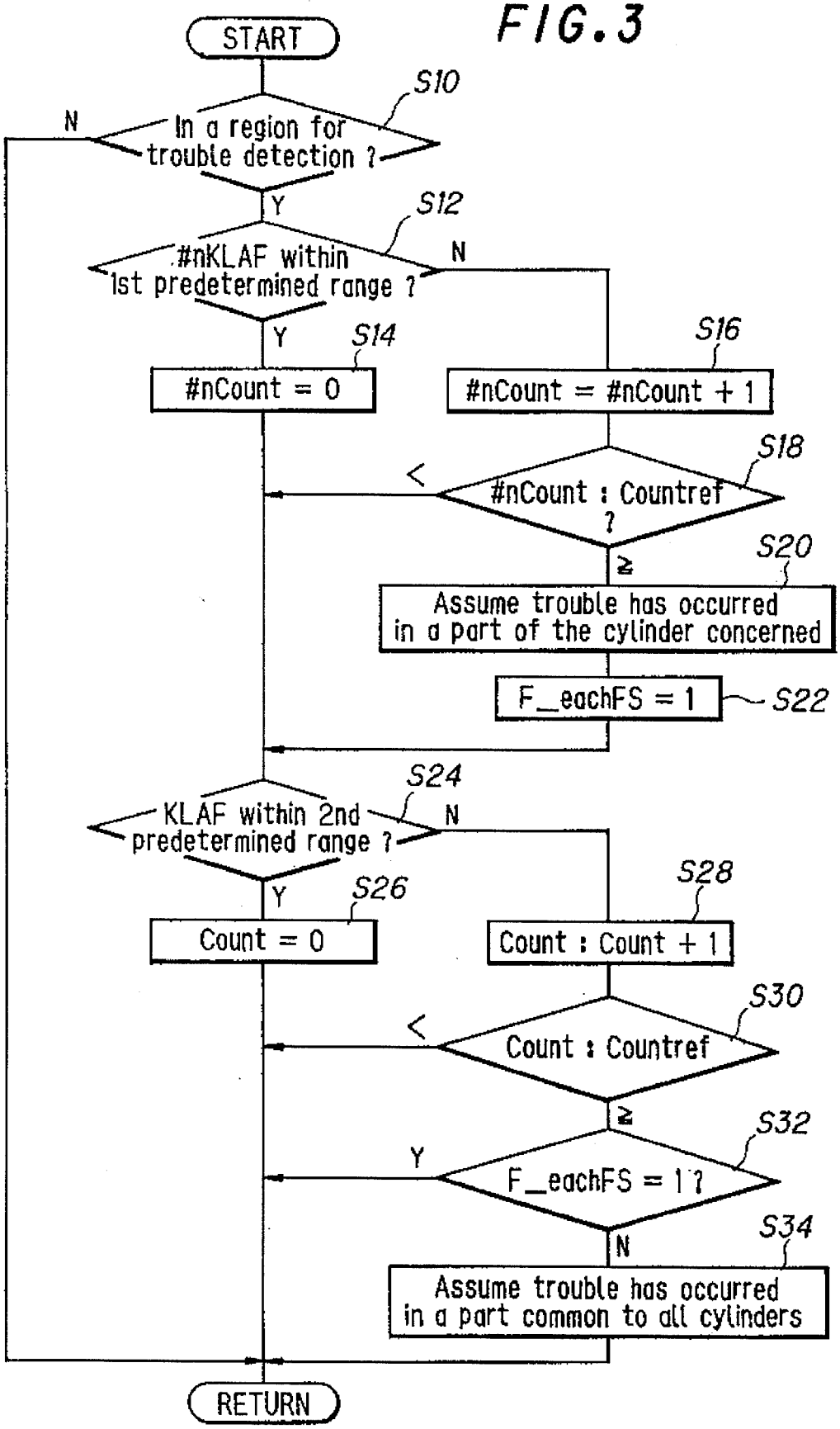
FIG. 3 is a flowchart which shows the operation of the trouble detection system for an internal combustion engine illustrated in FIG. 1.

The operation-of the system is shown by the flowchart of FIG. 3. Since, however, the system is based on a mathematical model which describes the behavior of the exhaust system which inputs the output from the LAF sensor and an observer which observes the internal state of the model such that air/fuel ratios in the individual cylinders are estimated from an output of the observer, before entering the explanation of the flowchart, the air/fuel ratio estimation through the observer will be described first.

Figure 4:
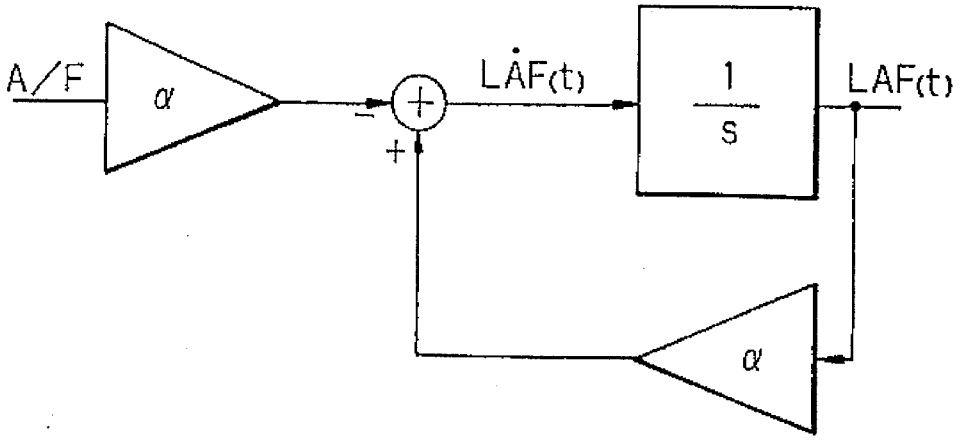
FIG. 4 is a block diagram showing a model which describes the behavior of detection of the air/fuel ratio referred to in the assignee's earlier application.

For high-accuracy separation and extraction of the air/fuel ratios in the individual cylinders from the output of a single LAF sensor it is necessary to first accurately ascertain the detection response delay (lag time) of the LAF sensor. The inventors therefore simulated this delay using a first-order lag time system as a model. For this they designed the model shown in FIG. 4. Here, if we define LAF:LAF sensor output and A/F:input air/fuel ratio, the state equation can be written as $$L\hat{A}F(t)=\alpha LAF(t)-\alpha A/F(t) \quad (1)$$

When this is discretized for period delta T, we get $$LAF(k+1)=\hat{\alpha}LAF(k)+(1-\hat{\alpha})A/F(k) \quad (2)$$

Here, $\hat{\alpha}$ is the correction coefficient and is defined as:

$$\hat{\alpha}+ee=1+\alpha\Delta T+(+e,\text{fra } 1/2!)\alpha^2\Delta T^2+(1/2!)\alpha^3\Delta T^3+(1/4!)\alpha^4\Delta T^4$$

Figure 5:
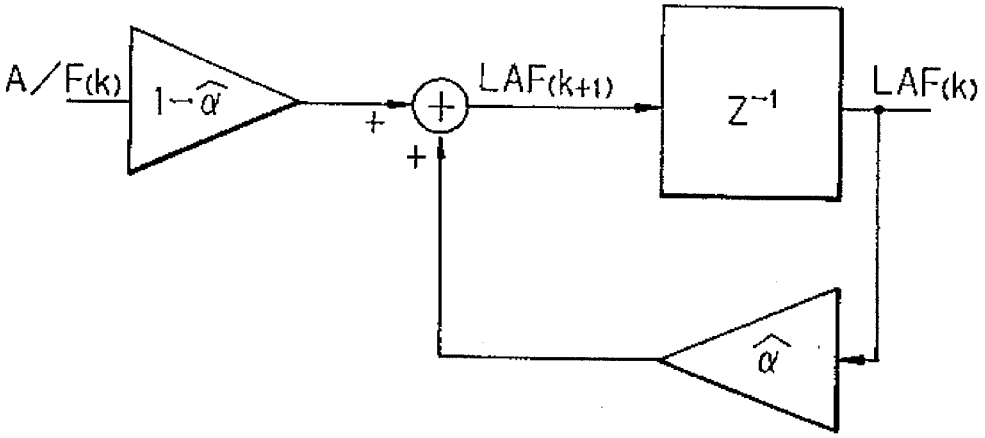
FIG. 5 is a block diagram which shows the model of FIG. 4 discretized in the discrete-time series for period delta T.

Equation 2 is represented as a block diagram in FIG. 5.

Therefore, Equation 2 can be used to obtain the actual air/fuel ratio from the sensor output. That is to say, since Equation 2 can be rewritten as Equation 3, the value at time k−1 can be calculated back from the value at time k as shown by Equation 4.

$$A/F(k)=\{LAF(k+1)-\hat{\alpha}LAF(k)\}/(1-\hat{\alpha}) \quad (3)$$

$$A/F(k-1)=\{LAF(k)-\hat{\alpha}LAF(k-1)\}/(1-\hat{\alpha}) \quad (4)$$

Figure 6:
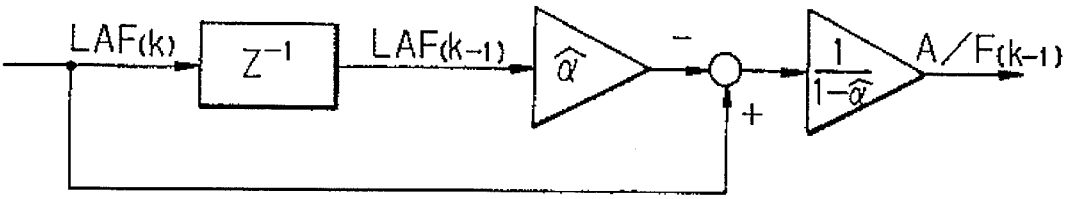
FIG. 6 is a block diagram which shows a real-time air/fuel ratio estimator based on the model of FIG. 5.

Specifically, use of the Z transformation to express Equation 2 as a transfer function gives Equation 5, and a real-time estimate of the air/fuel ratio input in the preceding cycle can be obtained by multiplying the sensor output LAF of the current cycle by the inverse transfer function. FIG. 6 is a block diagram of the real-time air/fuel ratio estimator.

$$t(z)=(1-\hat{\alpha})/(Z-\hat{\alpha}) \quad (5)$$

The method for separating and extracting the air/fuel ratios in the individual cylinders based on the actual air/fuel ratio obtained in the foregoing manner will now be explained. If the air/fuel ratio at the confluence point of the exhaust system is assumed to be an average weighted to reflect the time-based contribution of the air/fuel ratios in the individual cylinders, it becomes possible to express the air/fuel ratio at the confluence point at time k in the manner of Equation 6. (As F (fuel) was selected as the manipulated variable, the fuel/air ratio F/A is used here. For easier understanding, however, the air/fuel ratio will sometimes be used in the explanation. The term "air/fuel ratio" (or "fuel/ air ratio") used herein is the actual value corrected for the response lag time calculated according to Equation 5.)

$$[F/A](k) = C_1[F/A\#_1] + C_2[F/A\#_3] + C_3[F/A\#_4] + C_4[F/A\#_2] \tag{6}$$

$$[F/A](k+1) = C_1[F/A\#_3] + C_2[F/A\#_4] + C_3[F/A\#_2] + C_4[F/A\#_1]$$

$$[F/A](k+2) = C_1[F/A\#_4] + C_2[F/A\#_2] + C_3[F/A\#_1] + C_4[F/A\#_3]$$

$$\vdots$$

Figure 7:
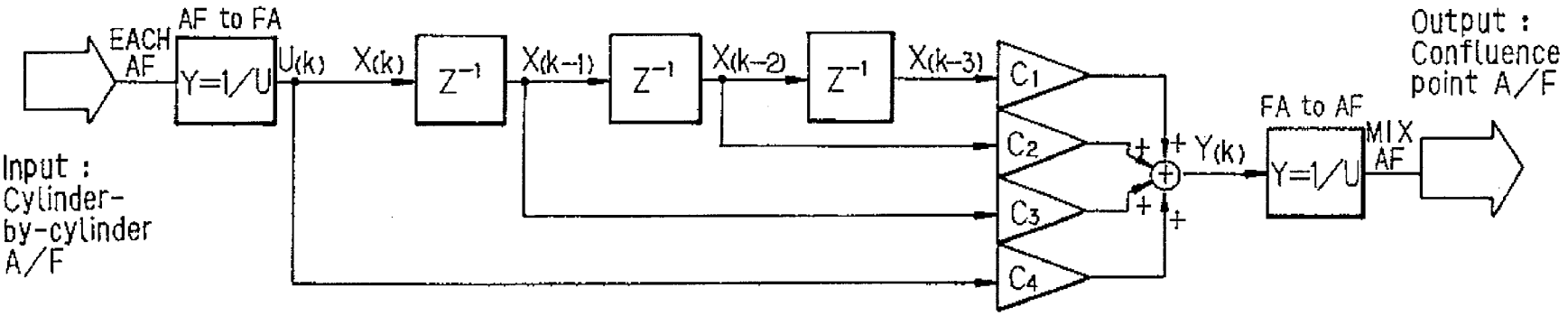
FIG. 7 is a block diagram showing a model which describes the behavior of the exhaust system of the engine referred to in the assignee's earlier application.

More specifically, the air/fuel ratio at the confluence point can be expressed as the sum of the products of the past firing histories of the respective cylinders and weighting coefficients C (for example, 40% for the cylinder that fired most recently, 30% for the one before that, and so on). This model can be represented as a block diagram as shown in FIG. 7.

Its state equation can be written as $$\begin{pmatrix} x(k-2) \\ x(k-1) \\ x(k) \end{pmatrix} = \begin{pmatrix} 010 \\ 001 \\ 000 \end{pmatrix} \begin{pmatrix} x(k-3) \\ x(k-2) \\ x(k-1) \end{pmatrix} + \begin{pmatrix} 0 \\ 0 \\ 1 \end{pmatrix} u(k) \tag{7}$$

Further, if the air/fuel ratio at the confluence point is defined as y(k), the output equation can be written as $$y(k) = [c_1 c_2 c_3] \begin{pmatrix} x(k-3) \\ x(k-2) \\ x(k-1) \end{pmatrix} + c_4 u(k) \tag{8}$$

Here:

$c_1$:0.25379, $c_2$:0.10121, $c_3$:0.46111, $c_4$:0.18389

Since u(k) in this equation cannot be observed, even if an observer is designed from the equation, it will still not be possible to observe x(k). Thus, if one defines x(k+1)=x(k−3) on the assumption of a stable operating state in which there is no abrupt change in the air/fuel ratio from that 4 TDCs earlier (i.e., from that of the same cylinder), Equation 9 is obtained.

$$\begin{pmatrix} x(k-2) \\ x(k-1) \\ x(k) \\ x(k+1) \end{pmatrix} = \begin{pmatrix} 0100 \\ 0010 \\ 0001 \\ 1000 \end{pmatrix} \begin{pmatrix} x(k-3) \\ x(k-2) \\ x(k-1) \\ x(k) \end{pmatrix} y(k) = [c_1 c_2 c_3 c_4] \begin{pmatrix} x(k-3) \\ x(k-2) \\ x(k-1) \\ x(k) \end{pmatrix} \tag{9}$$

Figure 8:
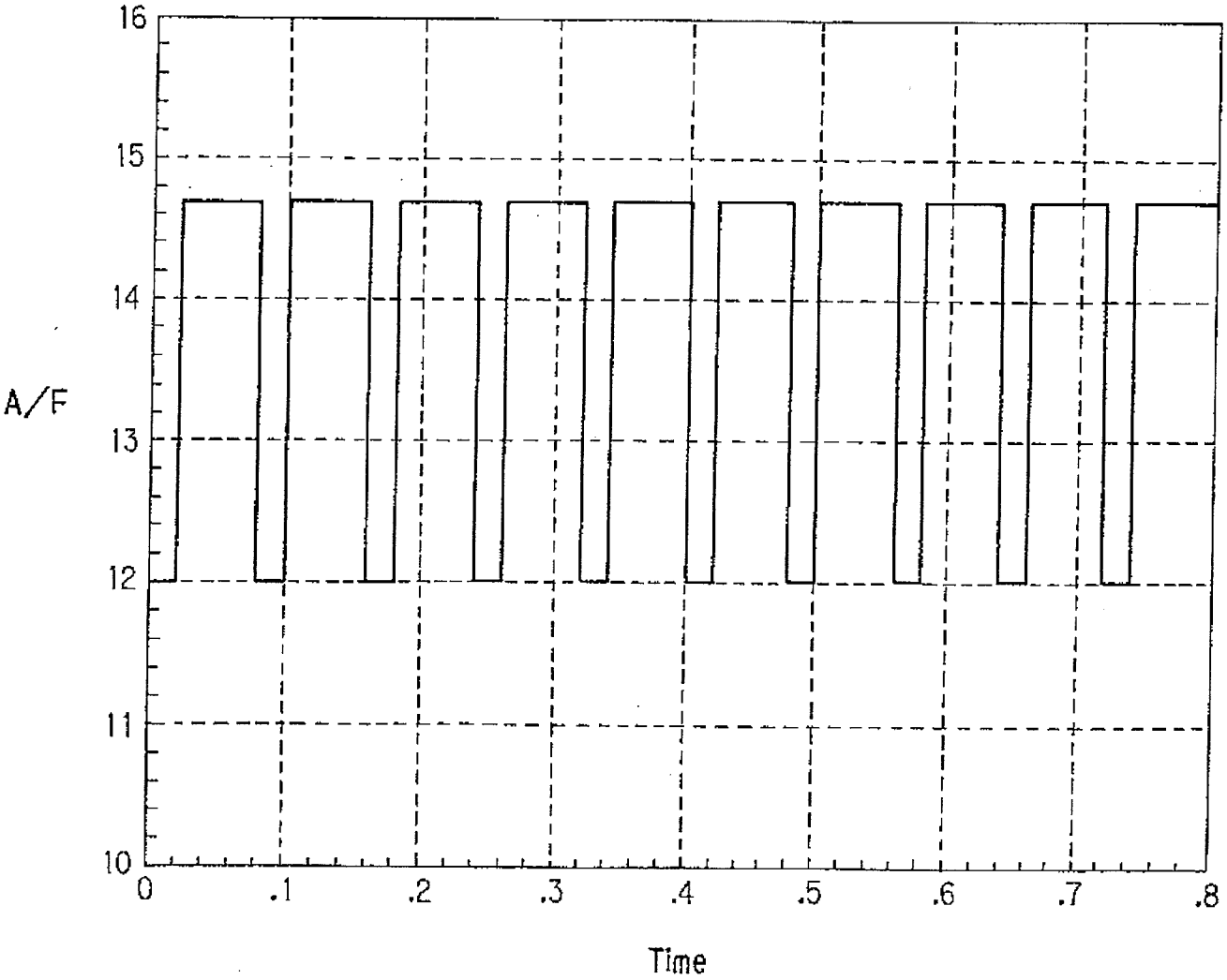
FIG. 8 is a graph of a simulation where fuel is assumed to be supplied to three cylinders of a four-cylinder engine so as to obtain an air/fuel ratio of 14.7:1 and to one cylinder so as to obtain an air/fuel ratio of 12.0:1.
Figure 9:
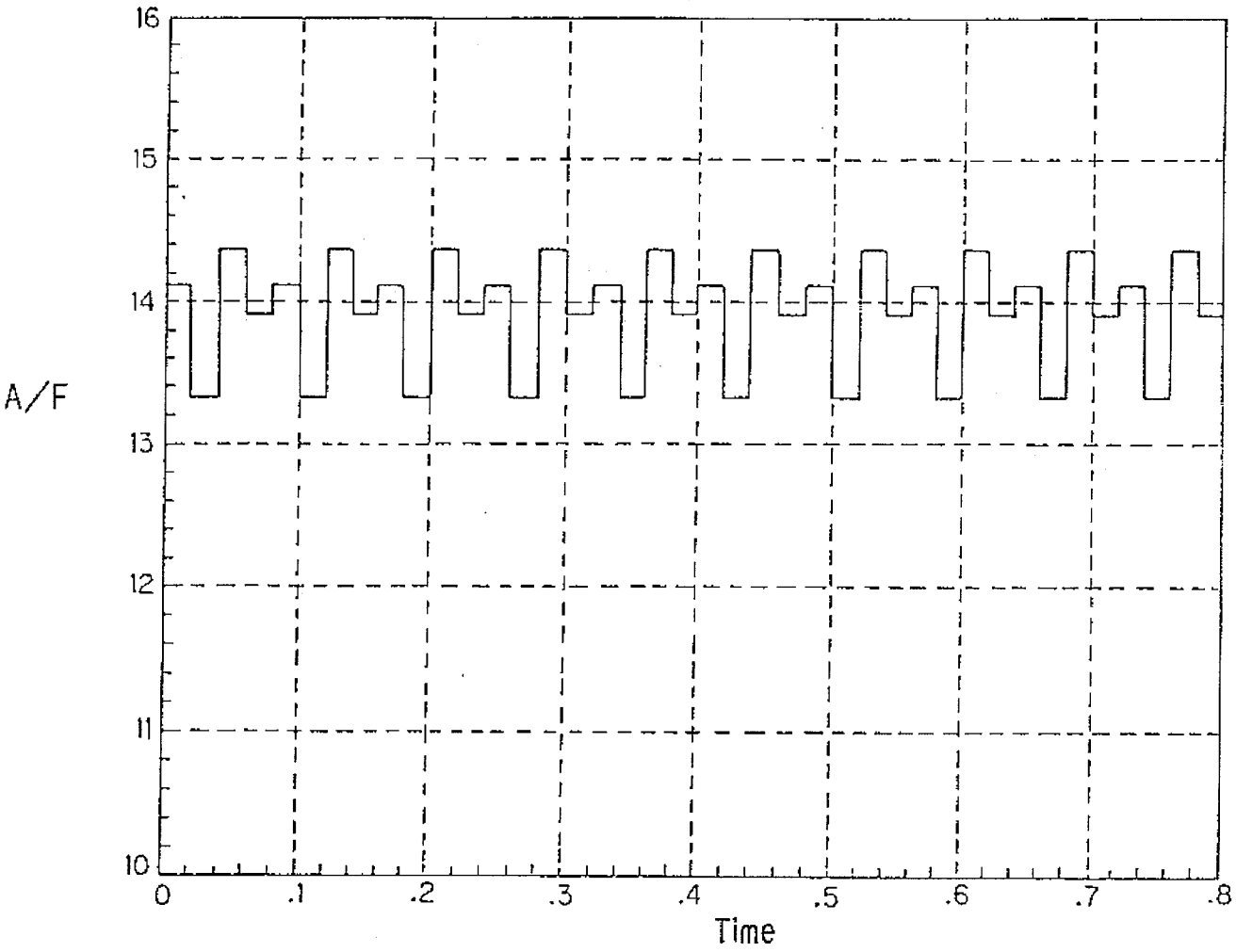
FIG. 9 is the result of the simulation which shows the output of the exhaust system model and the air/fuel ratio at a confluence point when the fuel is supplied in the manner illustrated in FIG. 8.
Figure 10:
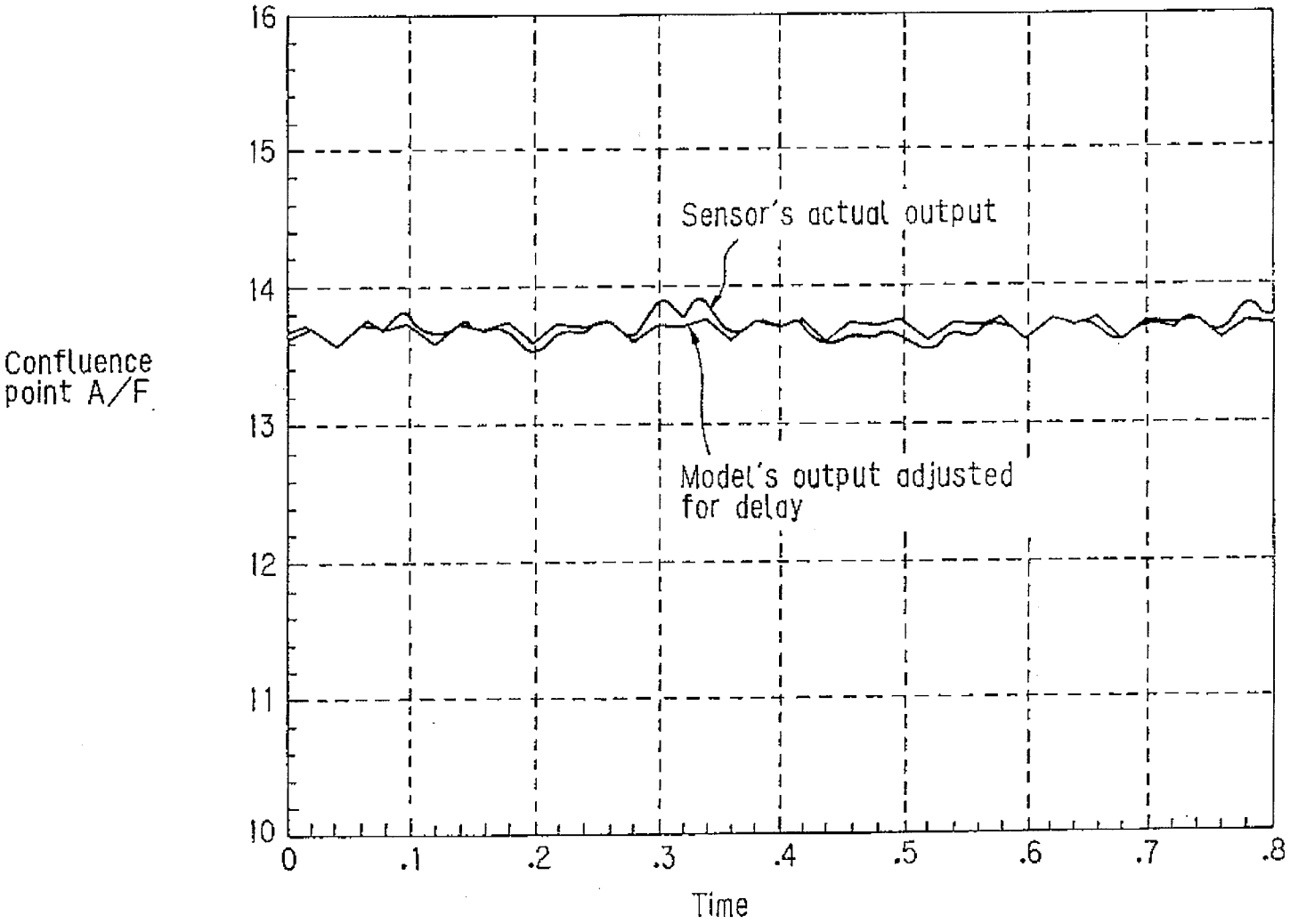
FIG. 10 is the result of the simulation which shows the output of the exhaust system model adjusted for sensor detection response delay (time lag) in contrast with the sensor's actual output.

The simulation results for the model obtained in the foregoing manner will now be given. FIG. 8 relates to the case where fuel is supplied to three cylinders of a four-cylinder internal combustion engine so as to obtain an air/fuel ratio of 14.7:1 and to one cylinder so as to obtain an air/fuel ratio of 12.0:1. FIG. 10 shows the air/fuel ratio at this time at the confluence point as obtained using the aforesaid model. While FIG. 9 shows that a stepped output is obtained, when the response delay (lag time) of the LAF sensor is taken into account, the sensor output becomes the smoothed wave designated "Model's output adjusted for delay" in FIG. 9. The curve marked "Sensor's actual output" is based on the actually observed output of the LAF sensor under the same conditions. The close agreement of the model results with this verifies the validity of the model as a model of the exhaust system of a multiple cylinder internal combustion engine.

Thus, the problem comes down to one of an ordinary Kalman filter in which x(k) is observed in the state equation, Equation 10, and the output equation. When the weighted matrices Q, R are determined as in Equation 11 and the Riccati's equation is solved, the gain matrix K becomes as shown in Equation 12.

$$\begin{cases} x(k+1) = AX(k) + Bu(k) \\ y(k) = CX(k) + Du(k) \end{cases} \tag{10}$$

Here:

$$A = \begin{pmatrix} 0100 \\ 0010 \\ 0001 \\ 1000 \end{pmatrix} C = [c_1 c_2 c_3 c_4] B = D = [0]$$

$$X(k) = \begin{pmatrix} x(k-3) \\ x(k-2) \\ x(k-1) \\ x(k) \end{pmatrix}$$

$$Q = \begin{pmatrix} 1000 \\ 0100 \\ 0010 \\ 0001 \end{pmatrix} R = [1] \tag{11}$$

$$K = \begin{pmatrix} -0.3093 \\ 1.1918 \\ 0.3093 \\ 0.0803 \end{pmatrix} \tag{12}$$

Obtaining A-KC from this gives Equation 13.

$$A - KC = \begin{pmatrix} 0.0785 & 1.0313 & 0.1426 & 0.0569 \\ -0.3025 & -0.1206 & 0.4505 & -0.2192 \\ -0.0785 & -0.0313 & -0.1426 & 0.9431 \\ 0.9796 & -0.0081 & -0.0370 & -0.0148 \end{pmatrix} \tag{13}$$

Figure 11:
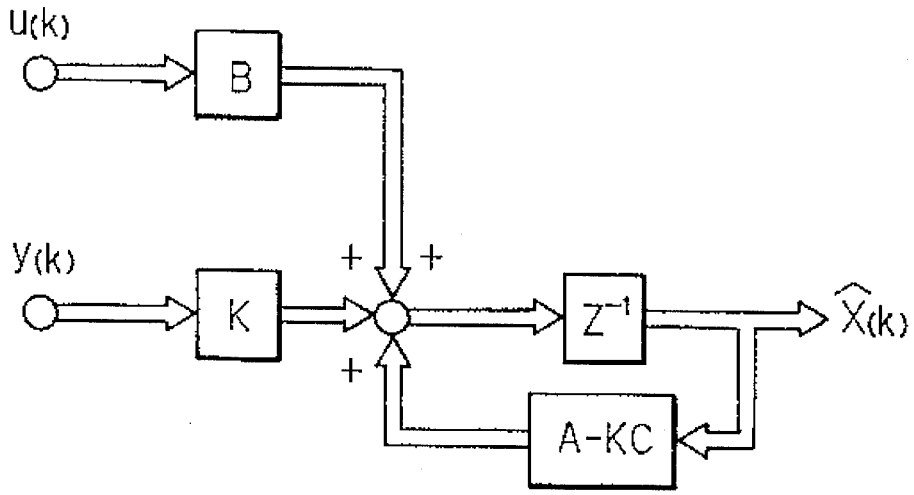
FIG. 11 is a block diagram which shows the configuration of an ordinary observer.
Figure 12:
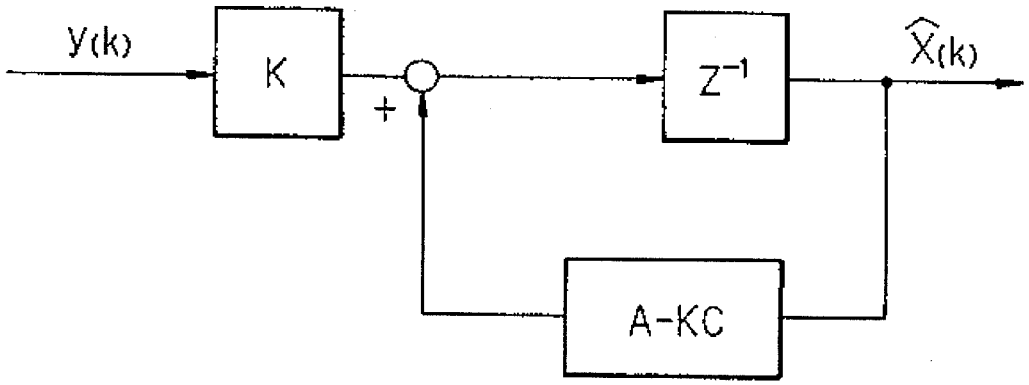
FIG. 12 is a block diagram which shows the configuration of the observer referred to in the assignee's earlier application.

FIG. 11 shows the configuration of an ordinary observer. Since there is no input u(k) in the present model, however, the configuration has only y(k) as an input, as shown in FIG. 12. This is expressed mathematically by Equation 14.

$$\begin{cases} \hat{X}(k+1) = [A - KC]\hat{X}(k) + Ky(k) \\ \hat{x}(k) = [0001]\hat{X}(k) \end{cases} \tag{14}$$

The system matrix of the observer whose input is y(k), namely of the Kalman filter, is $$S = \left( \begin{array}{c|c} A - KC & K \\ \hline 0001 & 0 \end{array} \right) \tag{15}$$

In the present model, when the ratio of the member of the weighted matrix R in Riccati's equation to the member of Q is 1:1, the system matrix S of the Kalman filter is given as $$S = \begin{pmatrix} 0.0785 & 1.0313 & 0.1426 & 0.0569 & -0.3093 \\ -0.3025 & -0.1206 & 0.4505 & -0.2192 & 1.1918 \\ -0.0785 & -0.0313 & -0.1426 & 0.9431 & 0.3093 \\ 0.9796 & -0.0081 & -0.0370 & -0.0148 & 0.0803 \\ 0.0 & 0.0 & 0.0 & 1.0 & 0.0 \end{pmatrix} \tag{16}$$

Figure 13:
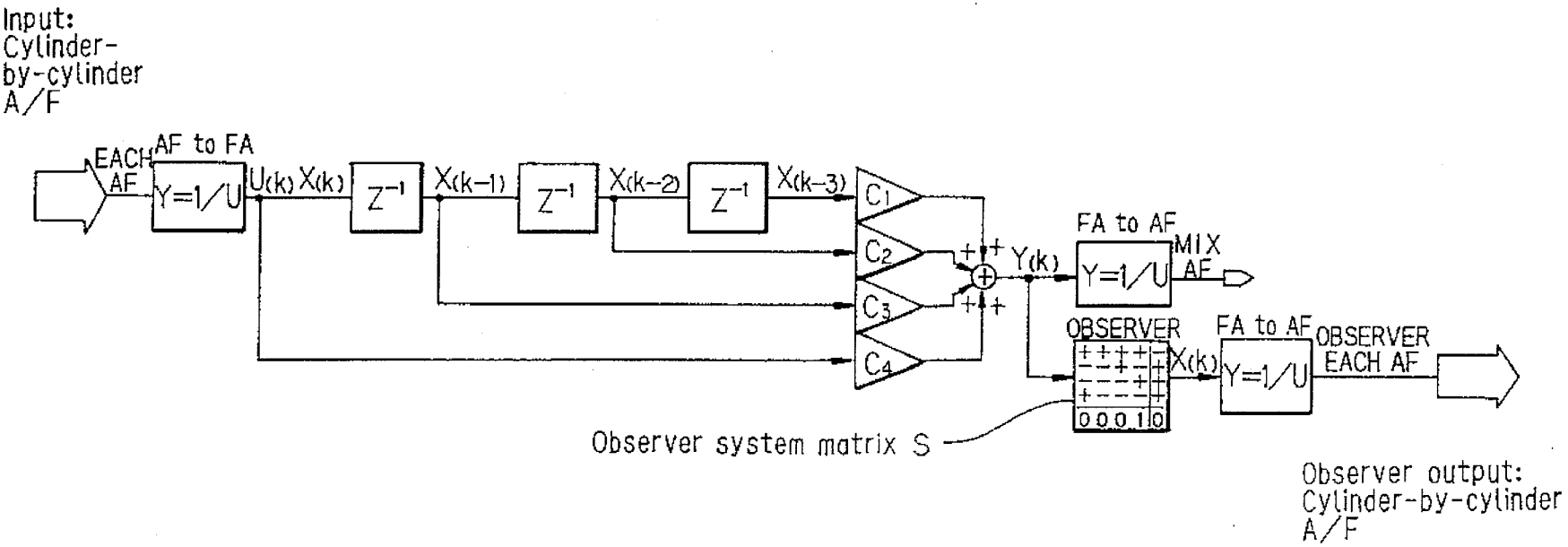
FIG. 13 is an explanatory block diagram which shows the configuration achieved by combining the model of FIG. 7 and the observer of FIG. 12.

FIG. 13 shows the configuration in which the aforesaid model and observer are combined. As this was described in detail in the assignee's earlier application, no further explanation will be given here.

Figure 14:
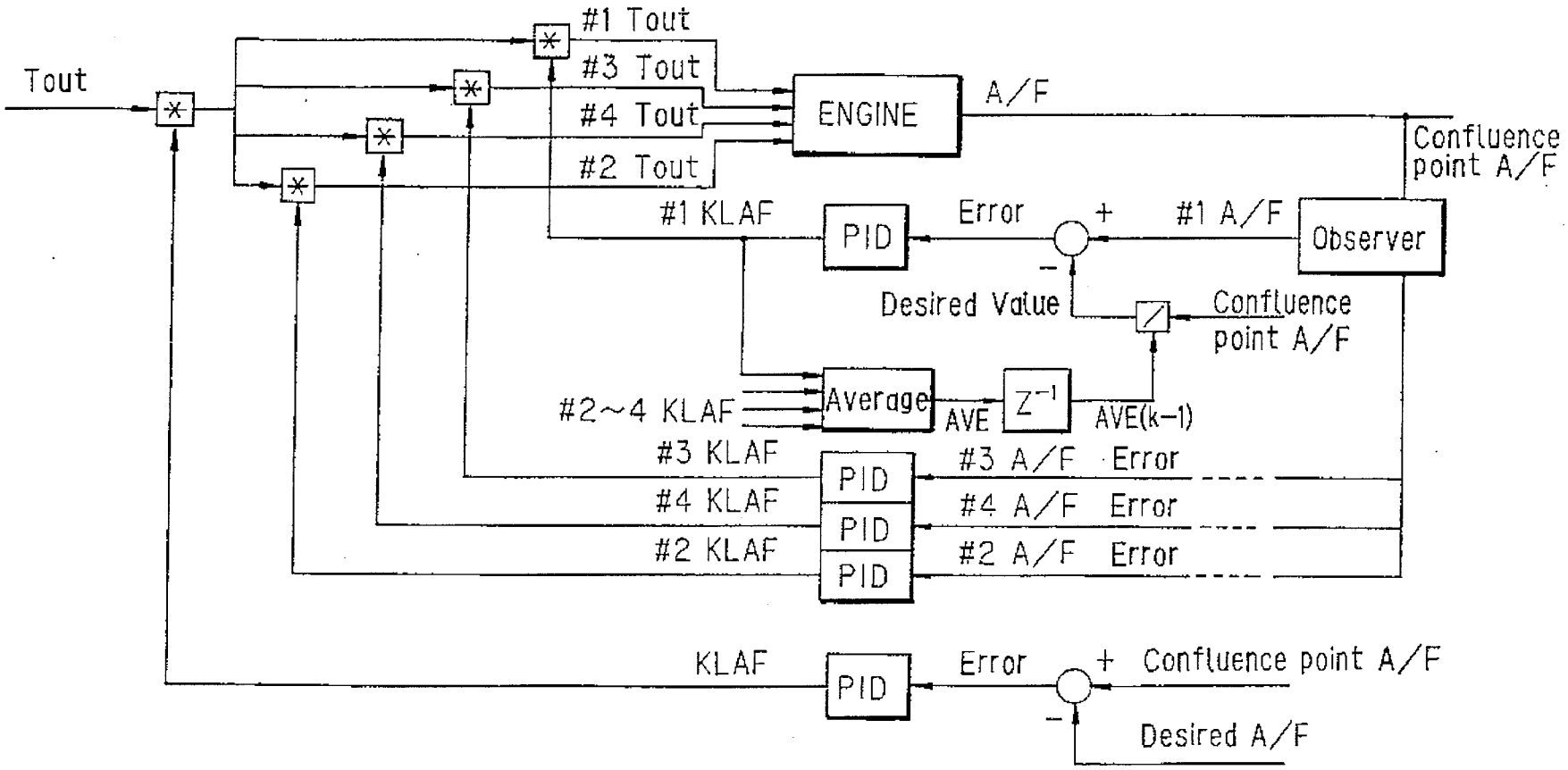
FIG. 14 is a block diagram which shows the overall configuration of an air/fuel ratio feedback control utilized in the trouble detection system according to this invention.

Since the observer is able to estimate the cylinder-by-cylinder air/fuel ratio (each cylinder's air/fuel ratio) from the air/fuel ratio at the confluence point, the air/fuel ratios in the individual cylinders can, as shown in FIG. 14, be separately controlled by a PID controller or the like.

Specifically, as shown in FIG. 14, only the variance between cylinders is absorbed by the cylinder-by-cylinder air/fuel ratio feedback factors (gains) #nKLAF and the error from the desired air/fuel ratio is absorbed by the confluence point air/fuel ratio feedback factor (gain) KLAF. More specifically, as disclosed the desired value used in the confluence point air/fuel ratio feedback control is the desired air/fuel ratio, while the cylinder-by-cylinder air/fuel ratio feedback control arrives at its desired value by dividing the confluence point air/fuel ratio by the average value AVEk−1 in the preceding cycle of the average value AVE of the cylinder-by-cylinder feedback factors #nKLAF of all the cylinders.

With this arrangement, the cylinder-by-cylinder feedback factors #nKLAF operate to converge the cylinder-by-cylinder air/fuel ratios to the confluence point air/fuel ratio and, moreover, since the average value AVE of the cylinder-by-cylinder feedback factors tends to converge to 1.0, the factors do not diverge and the variance between cylinders is absorbed as a result. On the other hand, since the confluence point air/fuel ratio converges to the desired air/fuel ratio, the air/fuel ratios of all cylinders should therefore be converged to the desired air/fuel ratio.

This is because when the cylinder-by-cylinder feedback factors #nKLAF are all set to 1.0 in the configuration of the cylinder-by-cylinder air/fuel ratio feedback loop shown in FIG. 14, the system operates until the feedback loop error disappears, i.e. until the denominator (the average value of the cylinder-by-cylinder feedback factors #nKLAF) becomes 1.0, indicating that the variance in air/fuel ratio between cylinders has been eliminated.

The fuel injection quantity #nTout here can be calculated in terms of the opening period of the fuel injector 20 as $$\#nTout = Tim \times KCMD \times KTOTAL \times \#nKLAF \times KLAF$$

where Tim:base value, KCMD:desired air/fuel ratio (expressed as equivalence ratio to be multiplied by the base value), KTOTAL:other correction factors. While an addition factor for battery correction and other addition factors might also be involved, they are omitted here. As this control is described in detail in the assignee's earlier Japanese Patent Application No. Hei 5(1993)-251,138, it will not be described further here.

Based on the foregoing, the operation of the malfunction detection system according to the invention will now be explained with reference to the flowchart of FIG. 3. The program is started at every TDC crank angle positions. Using a timer, alternatively, the program may be started periodically.

The program begins at step S10 where it is checked whether the engine operation is in a region suitable for malfunction detection. As will be apparent as the description goes, since the malfunction detection system according to the invention detects a malfunction using the cylinder-by-cylinder air/fuel ratio feedback factors #nKLAF or the confluence point air/fuel ratio feedback factor KLAF, the malfunction detection is conducted in a region where the air/fuel ratio feedback control is carried out and in addition, the engine operation is relatively stable, i.e., the engine runs relatively stably or the engine is idling, so as to avoid errors.

The program terminates immediately if the result of the step S10 is negative. Otherwise, the program proceeds to step S12 where it is respectively discriminated whether the aforesaid cylinder-by-cylinder air/fuel ratio feedback factors #nKLAF (n:cylinders) are within a first predetermined range, e.g. from 0.7 to 1.3. If it is found in the step that one or all of the four cylinders' feedback factors #nKLAF is within the first predetermined range, the program moves to step S14 in which one among four counters #nCount (n:cylinder) is reset to zero for the cylinder concerned.

On the other hand, if it is discriminated in step S12 that any of the feedback factors #nKLAF is outside of the first predetermined range, the program advances to step S16 in which the counter #nCount corresponding to the cylinder concerned is incremented or counted up, to step S18 in which it is discriminated whether the counter value #nCount reaches a reference value Countref and if it does, to step S20 in which it is assumed that a malfunction has occurred in a particular part of the cylinder concerned. At the same time, any warning or any countermeasure such as retarding ignition timing should preferably be conducted.

Malfunctions which occur in a cylinder are caused by abnormalities which may affect the air/fuel ratio in the cylinder such as clogging of the fuel injector 20 which supplies fuel only to the cylinder concerned, or the ignition system including the ignition distributor for supplying spark voltage only to the cylinder concerned. When the engine 10 is equipped with such a variable valve timing mechanism as is taught by Japanese Laid-open Patent Application Hei 2(1990)-275,043, the malfunction may include the abnormalities which may occur in the hydraulic system which drives the connecting pin for switching the valve timing.

The program then goes to step S22 in which an one bit flag F.eachFS is set to 1 and then to step S24. If it is discriminated in step S18 that the counter value does not reach the reference value, the program goes immediately to step S24.

Then it is discriminated in step S24 whether another feedback factor KLAF (the confluence point air/fuel ratio feedback factor) is within a second predetermined range, e.g. from 0.6 to 1.4 and if it is, the program proceeds to step S26 in which a single counter Count is reset to zero. If step S24 finds that the second feedback factor KLAF is outside of the second predetermined range, on the other hand, the program advances to step S28 where the counter Count is incremented or counted up, to step S30 where it is discriminated whether the counter value Count reaches the aforesaid reference value Countref and if it does, to step S32 in which it is checked whether the bit of the aforesaid flag F.eachFS is set to 1, in other words, it is checked whether a local malfunction has occurred in any of the cylinders. This is because, the occurrence of a local malfunction, more precisely, the air/fuel change due to the occurrence of a local malfunction would cause the feedback factor KLAF to be outside of the second predetermined range, thereby causing an erroneous misjudgment.

If it is found in step S32 that the flag's bit is not set to 1, the program advances to step S34 in which it is assumed that any malfunction has occurred in a part of the overall system which affects the air/fuel ratios of all the cylinders. In other words, it is assumed in the step that an abnormality has occurred in a part other than the fuel injector or any other part which would affect the air/fuel ratio only one cylinder.

An example of such a malfunction would be an abnormality in any part of the fuel pressure system including the fuel pump, the pressure regulator etc., an abnormality in the fuel injector drive circuit 66 (FIG. 2), an abnormality in the mechanism for driving the intake or exhaust valves etc. When the engine 10 is equipped with a variable valve timing mechanism, an abnormality in the hydraulic system would be included in the malfunctions discussed here. As in step S20, any warning or countermeasure should preferably be taken in this step.

On the contrary, if step S30 finds that the counter value does not reach the reference value, the program is immediately terminated. Similarly the program is immediately terminated so as to avoid misjudgment when step S32 finds that the bit of the flag is set to 1.

Here, the reason why the occurrence of a malfunction can be determined from the feedback factors will be explained.

As mentioned earlier, in the air/fuel ratio feedback control disclosed, the cylinder-by-cylinder air/fuel ratio feedback factors #nKLAF operate to absorb the air/fuel ratio variance between cylinders and to converge the individual cylinders' air/fuel ratios to the confluence point air/fuel ratio, while the confluence point air/fuel ratio feedback factor KLAF operates to converge the confluence point air/fuel ratio to the desired air/fuel ratio. The air/fuel ratios of all cylinders can therefore be converged to the desired air/fuel ratio.

With this arrangement, any of the feedback factors #nKLAF for a certain cylinder has a prescribed value, i.e. outside of the first predetermined range, it therefore becomes possible to assume that any abnormality which would occur in a part such as the fuel injector which would affect the air/fuel ratio in the cylinder concerned. Similarly, if the confluence point air/fuel ratio feedback factor KLAF also has a prescribed value, i.e. outside of the second predetermined range while none of the feedback factors #nKLAF is within the first predetermined range, it becomes possible to assume that any abnormality which would occur in a part such as the fuel pressure system which would affect the air/fuel ratios of the whole cylinders. Thus, the system according to the invention, is simple in structure, and can detect a malfunction immediately and accurately.

In the foregoing, moreover, the counters #nCount or the counter Count is incremented when the relevant feedback factor #nKLAF concerned is outside of the first predetermined range or when the feedback factor KLAF is outside of the second predetermined range and when the counter value reaches the reference value Countref, the occurrence of a malfunction is assumed. With this arrangement, it is possible to prevent some transient abnormality from being assumed to be an actual malfunction.

It should be noted in the foregoing that, although the first predetermined range referred to in step S12 and the second predetermined range referred to in step S24 are normally different, it is also possible to make them equal. Moreover, although the same reference value is used in steps S18 and S30, it is also possible to make the value different for the steps.

It should further be noted that, although the foregoing embodiment has been explained with respect to examples in which the actual air/fuel ratio is derived by analyzing the response delay of a wide-range air/fuel ratio sensor and that the air/fuel ratios in the individual cylinders are obtained based thereon from the output of a single sensor at the confluence point, the system according to this invention is not limited to this arrangement and can instead be configured to have air/fuel ratio sensors disposed in the exhaust system in a number equal to the number of cylinders and to use their outputs for measuring the air/fuel ratios in the individual cylinders.

The present invention has thus been shown and described with reference to specific embodiments. However, it should be noted that the present invention is in no way limited to the details of the described arrangements and that changes and modifications can be made without departing from the scope of the appended claims.

What is claimed is:

1. A system for detecting a malfunction occurring in an internal combustion engine, comprising:

air/fuel detecting means for detecting an exhaust air/fuel ratio at a confluence point of an exhaust system of said engine;

a fuel injector installed in said engine for injecting fuel into individual cylinders of said engine that is connected to fuel pressure system including a fuel pump; and a control unit functioning to provide (a) an air/fuel ratio determination computation for determining exhaust air/fuel ratios in said individual cylinders of said engine;

(b) a first feedback factor determination computation for establishing a confluence point air/fuel ratio feedback factor KLAF in response to a detected error between said exhaust confluence point air/fuel ratio and a predetermined air/fuel ratio;

(c) a second feedback factor determination computation for establishing cylinder-by-cylinder air/fuel ratio feedback factors #nKLAF for said individual cylinders at least in response to a variance between computed exhaust air/fuel ratios of said individual cylinders;

(d) a feedback control means for computing a fuel injection quantity to be supplied to said individual cylinders such that said detected error between said exhaust confluence point air/fuel ratio and said air/fuel ratio decreases;

(e) a discrimination computation for determining whether at least one of said cylinder-by-cylinder air/fuel ratio feedback factors #nKLAF is within a predetermined range;

(f) a malfunction determination computation which assumes that, when at least one of said cylinder-by-cylinder air/fuel ratio feedback factors #nKLAF is determined to be outside of said predetermined range, a malfunction has occurred in a part of said engine installed with said fuel injector which would affect said air/fuel ratio in one of said cylinders; and (g) a countermeasure means for taking at least one of warning and countermeasure in response to said assumption of said malfunction determination computation.

2. A system according to claim 1, wherein said discrimination computation determines whether said cylinder-by cylinder air/fuel ratio feedback factors #nKLAF are within said first predetermined range and whether said confluence point air/fuel ratio feedback factor KLAF is within a second predetermined range, and said malfunction determination computation assumes that, if said confluence point air/fuel ratio feedback factor KLAF is determined to be outside of said second predetermined range while said cylinder-by-cylinder air/fuel ratio feedback factors #nKLAF are determined to be within said first predetermined range, a malfunction has occurred in said part of said engine which would affect said confluence point air/fuel ratio of said engine.

3. A system according to claim 1, wherein said malfunction determination computation includes counting means for counting up a number at which at least one of said cylinder-by-cylinder air/fuel ratio feedback factors #nKLAF is determined to be outside of said first predetermined range, and when the counter value reaches a reference value, assumes that a malfunction has occurred.

4. A system according to claim 1, wherein said malfunction determination computation includes counting means for counting up a number at which said confluence point air/fuel ratio feedback factor KLAF is determined to be outside of said second predetermined range, and when the counter value reaches a reference value, assumes that a malfunction has occurred.

5. A system according to claim 1, wherein said malfunction occurred in said part of said engine includes clogging of said fuel injector of said one of said individual cylinders.

6. A system according to claim 2, wherein said malfunction occurred in said part of said engine is at least one of said fuel pressure system, a fuel injector drive circuit and a mechanism for driving intake or exhaust valves of said engine.

* * * * *

UNITED STATES PATENT AND TRADEMARK OFFICE

CERTIFICATE OF CORRECTION

PATENT NO. : 5,542,404

DATED : August 6, 1996

INVENTOR(S) : Hasegawa et al.

It is certified that error appears in the above-identified patent and that said Letters Patent is hereby corrected as shown below:

On the title page:

Item [75], line 2, delete "Shushuke" insert therefor -- Shusuke --.

Signed and Sealed this

Twelfth Day of November, 1996

Bruce Lehman

*Attest:*

BRUCE LEHMAN

*Attesting Officer*

*Commissioner of Patents and Trademarks*